US011073142B2

(12) United States Patent
Oh

(10) Patent No.: US 11,073,142 B2
(45) Date of Patent: Jul. 27, 2021

(54) AIR-CONDITIONER COMPRESSOR FOR VEHICLE

(71) Applicant: HYUNDAI MOTOR COMPANY, Seoul (KR)

(72) Inventor: Dong-Seok Oh, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 924 days.

(21) Appl. No.: 15/371,912

(22) Filed: Dec. 7, 2016

(65) Prior Publication Data

US 2018/0135609 A1 May 17, 2018

(30) Foreign Application Priority Data

Nov. 2, 2016 (KR) ..... 10-2016-0145122

(51) Int. Cl.

| | |
|---|---|
| ***F04B 27/067*** | (2006.01) |
| ***F04B 27/10*** | (2006.01) |
| ***F04B 27/18*** | (2006.01) |
| ***F04B 49/00*** | (2006.01) |

(52) U.S. Cl.

CPC ..... *F04B 27/067* (2013.01); *F04B 27/1072* (2013.01); *F04B 27/18* (2013.01); *F04B 49/002* (2013.01)

(58) Field of Classification Search

CPC .... F04B 27/067; F04B 27/18; F04B 27/1072; B60H 1/3223; B60H 1/3205

See application file for complete search history.

(56) References Cited

U.S. PATENT DOCUMENTS

| | | | | |
|---|---|---|---|---|
| 3,749,523 | A * | 7/1973 | Wahl, Jr. | F04B 1/124 417/269 |
| 5,259,736 | A * | 11/1993 | Terauchi | F01B 3/106 417/222.1 |
| 2010/0209261 | A1* | 8/2010 | Lee | F04B 27/1072 417/222.1 |
| 2015/0086391 | A1 | 3/2015 | Yamamoto et al. | |
| 2016/0003227 | A1* | 1/2016 | Yamashita | F04B 27/1063 417/218 |

FOREIGN PATENT DOCUMENTS

| | | | |
|---|---|---|---|
| CN | 1075778 | A | 9/1993 |
| CN | 101828033 | A | 9/2010 |
| JP | 1997-088808 | A | 3/1997 |
| JP | 2000-283021 | A | 10/2000 |
| KR | 20120040582 | A | 4/2012 |
| KR | 101475729 | B1 | 12/2014 |
| KR | 10-1491329 | B1 | 2/2015 |
| KR | 20150034108 | A | 4/2015 |
| KR | 2015-0080190 | A | 7/2015 |

* cited by examiner

*Primary Examiner* — Charles G Freay
*Assistant Examiner* — David N Brandt
(74) *Attorney, Agent, or Firm* — McDonnell Boehnen Hulbert & Berghoff LLP

(57) ABSTRACT

A vehicle air-conditioner compressor may include a housing having a front housing section and a rear housing section; a shaft rotatably installed in the housing; a lug fixed at a preset position on the shaft; a swash plate coupled with the lug at one side thereof and rotating together with the lug, a piston connected to the swash plate by a shoe and moved reciprocatingly by the swash plate; a cylinder that accommodates the piston therein, and a pressure-sensing chamber coupled with a rod at the other side of the swash plate, that operates the rod using a pressure provided from a high-pressure chamber of the rear housing.

7 Claims, 8 Drawing Sheets

AIR-CONDITIONER COMPRESSOR FOR VEHICLE

CROSS-REFERENCE(S) TO RELATED APPLICATIONS

This application claims benefit of priority to Korean Patent Application No. 10-2016-0145122, filed on Nov. 12, 2016, which is incorporated herein by reference in its entirety.

BACKGROUND

Technical Field

Example embodiments of the present disclosure relate to an air-conditioner compressor for a vehicle, and more particularly, to an air-conditioner compressor for a vehicle in which a discharge capacity is varied depending on an interior temperature of the vehicle without the need for a control valve while using a stationary compressor.

Description of Related Art

An air-conditioner of a vehicle is an apparatus for maintaining a comfortable interior air temperature and humidity, in which cold air or warm air is discharged depending on the interior temperature of a vehicle.

In the case of cooling, a process of compressing, condensing, expanding, and evaporating an air-conditioning coolant is repeatedly performed to systemically control cooling and dehumidification, thereby maintaining a comfortable interior air condition in the vehicle.

The coolant is compressed by a compressor that receives power from the engine crankshaft via a pulley. The compressor compresses a low-temperature, low-pressure gaseous coolant discharged from an evaporator to a high-temperature, high-pressure gaseous state, and then discharges the coolant to a condenser.

The compressor increases the pressure of the coolant to form a liquid coolant phase. A pulley of the compressor is driven by an engine belt, and the driving force of the pulley causes a swash plate to rotate. Rotation of the swash plate causes a piston to reciprocatingly move in a cylinder, thereby creating pressure differentials and converting evaporated low-temperature, low-pressure coolant gas fed from an evaporator to a high-temperature, high-pressure overheated steam state, and transferring the coolant in the high-temperature and high-pressure overheated steam state to the condenser.

A swash plate compressor as described above may be either a stationary compressor in which a tilt angle of the swash plate is fixed, or a variable compressor in which the tilt angle of the swash plate is adjustable.

A variable compressor may be either an internal variable compressor in which capacity may be changed by a mechanical control valve depending on a coolant pressure and a pressure setting for the control valve, or an external variable compressor in which capacity may be changed by an electronic control valve and a controller controls the control valve based on a temperature setting and a driving environment.

As shown in FIG. 1A, stationary compressors are low cost but have low fuel efficiency, whereas external variable compressor are high cost but have high fuel efficiency.

Internal variable compressors fall in-between the stationary compressor and the external variable compressor in terms of cost and fuel efficiency.

Further, referring to FIG. 1B, when a stationary compressor is used, once the vehicle interior is cooled, the interior temperature is controlled by repetitive cycling of the compressor, that results in more inconsistent control of interior temperature and humidity, and a deterioration of power performance of the compressor. In contrast, in the case of the variable compressor, because the discharge capacity may be varied, a minimum discharge amount may be maintained without cycling the compressor on and off, thereby improving interior comfort and compressor power performance.

Because the discharge capacity of a stationary compressor is fixed during operation, the compressor is always operated at a maximum discharge capacity, resulting in low fuel efficiency.

However, because the tilt angle of the swash plate in a variable compressor can be changed depending on the interior temperature, although fuel efficiency is high, material cost is increased.

Accordingly, a compressor that is low cost and that may also be operated in variable mode to improve vehicle interior comfort while maintaining high fuel efficiency is required.

SUMMARY OF THE DISCLOSURE

In an example embodiment, the present disclosure provides an air-conditioner compressor for a vehicle capable of varying an inclination of a swash plate in a stationary compressor, without need for the addition of a control valve, by using high pressure fluid discharged from a high-pressure chamber. This configuration allows for improved fuel efficiency and compressor power, while maintaining interior comfortability and minimizing overall cost as compared to a variable compressor.

Other objects and advantages can be understood by the following description, and become apparent with reference to the embodiments of the present disclosure. Also, it is obvious to those skilled in the art that the objects and advantages of the present disclosure can be realized by the means as claimed and combinations thereof.

In accordance with an example embodiment, an air-conditioner compressor for a vehicle comprises: a housing having a front section and a rear section; a shaft rotatably installed in the housing; a lug fixed at a preset position of the shaft; a swash plate that is coupled with the lug at one side thereof and rotates together with the lug; a piston connected to the swash plate by a shoe and reciprocatingly moved by the swash plate; a cylinder accommodating the piston therein so that the piston reciprocatingly moves in the housing; and a first pressure-sensing chamber that is coupled with a rod at the other side of the swash plate, wherein pressure from a high-pressure chamber of the rear housing moves the rod to change an inclination of the swash plate with respect to a direction perpendicular to a length direction of the shaft.

The swash plate may be coupled with a bushing sliding along the shaft.

The vehicle air-conditioner compressor may further comprise a spring installed between the lug and the bushing to elastically move the swash plate connected to the bushing. The spring may have a preset spring constant.

A stopper may be disposed on the shaft at one side of the pressure-sensing chamber in a bushing direction.

A minimum inclination of the swash plate may be set by the stopper. The minimum inclination may be 1 degree or greater.

The rear housing may include a second pressure-sensing chamber into which the shaft is press-fitted; a low-pressure chamber surrounding the pressure-sensing chamber and communicating with the housing and the cylinder; and a high-pressure chamber surrounding the low-pressure chamber.

A communicating channel may be formed between the high-pressure chamber and the pressure-sensing chamber.

Pressure in the first pressure-sensing chamber may be transferred to the second pressure-sensing chamber through a communicating hole formed in the shaft.

The front housing may include a support that supports the shaft; a low-pressure chamber surrounding the support and communicating with the housing and the cylinder; and a high-pressure chamber surrounding the low-pressure chamber.

The lug may include a rotating plate; a hinge body formed at one end of the rotating plate; a slot hole formed in the hinge body; and a hinge pin sliding along the slot hole and coupled with one side of hinge body and one side of the swash plate.

When the inclination of the swash plate is at a maximum value, the hinge pin may be positioned at one end of the slot hole, and when the inclination of the swash plate is at a minimum value, the hinge pin may be positioned at the other end of the slot hole.

High pressure is generated on the side of the piston that is moving towards the high pressure chamber, while low pressure is generated on the side of the piston moving away form a high pressure chamber. The piston may be symmetrical with respect the swash plate such that a force generated by the high pressure and a force generated by the low pressure are offset against each other.

DESCRIPTION OF SPECIFIC EMBODIMENTS

Terms and words used in the present specification and claims are not to be construed as a general or dictionary meaning but are to be construed as meaning and concepts meeting the technical ideas of the present disclosure based on a principle that the inventors can appropriately define the concepts of terms in order to describe their own inventions in best mode. Therefore, the configurations described in the embodiments and drawings of the present disclosure are merely example embodiments but do not represent all of the technical spirit of the present invention. Thus it should be understood that there may exist various equivalents and modifications for substituting those at the time of filing this application. Moreover, detailed descriptions related to well-known functions or configurations will be omitted in order not to unnecessarily obscure the gist of the present disclosure. Hereinafter, preferred embodiments of the present disclosure are described in detail with reference to the accompanying drawings.

1. Air-Conditioner Compressor for Vehicle

Figure 1A:
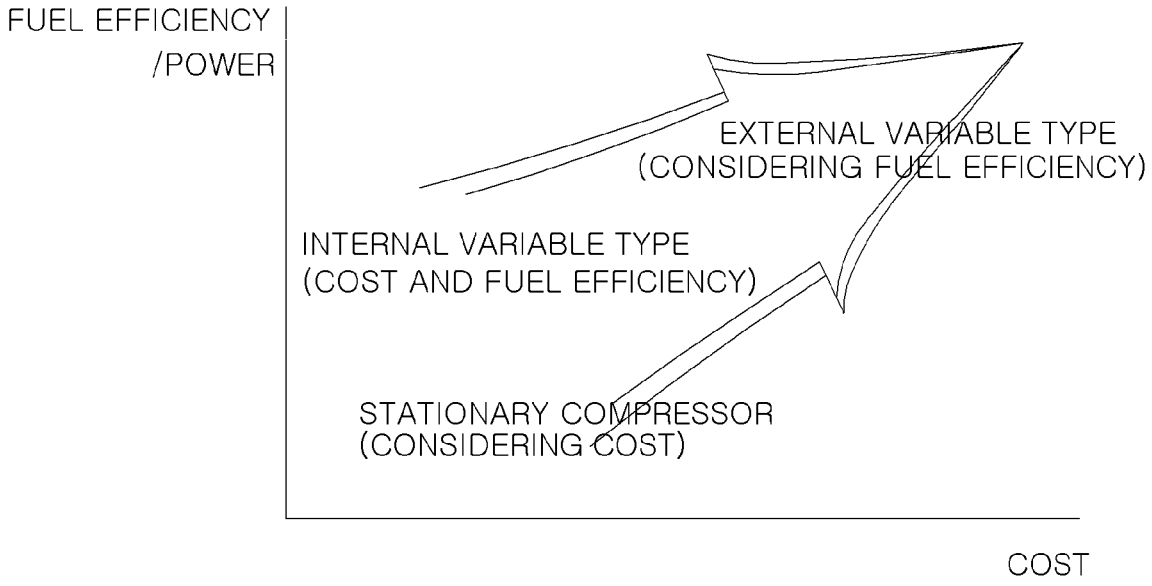
FIG. 1A is a conceptual illustration comparing the cost and fuel efficiency/power of various air-conditioner compressors in accordance with the related art.
Figure 1B:
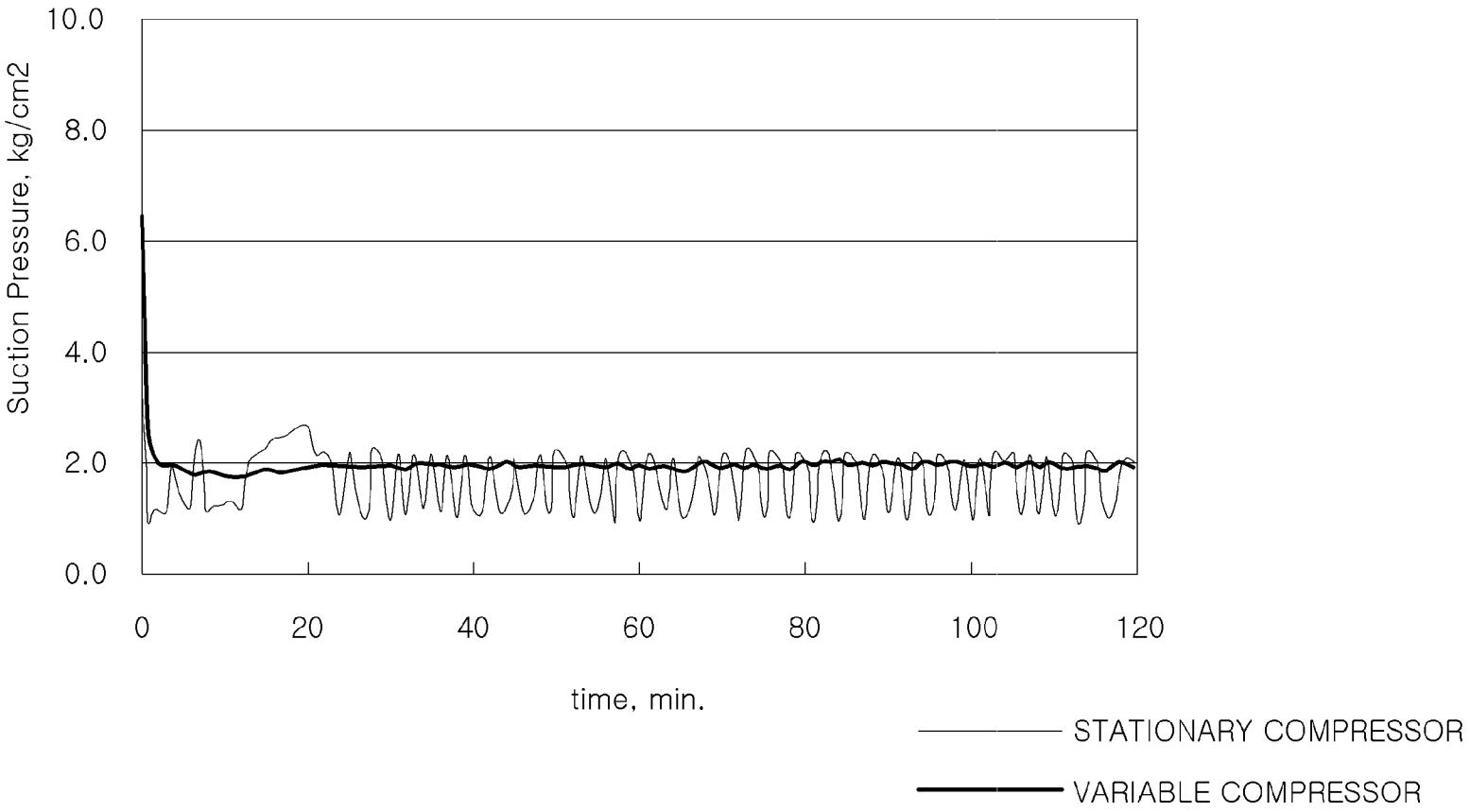
FIG. 1B is a graph illustrating changes in suction pressures of a stationary air-conditioner compressor and a variable air-conditioner compressor in accordance with the related art.
Figure 2:
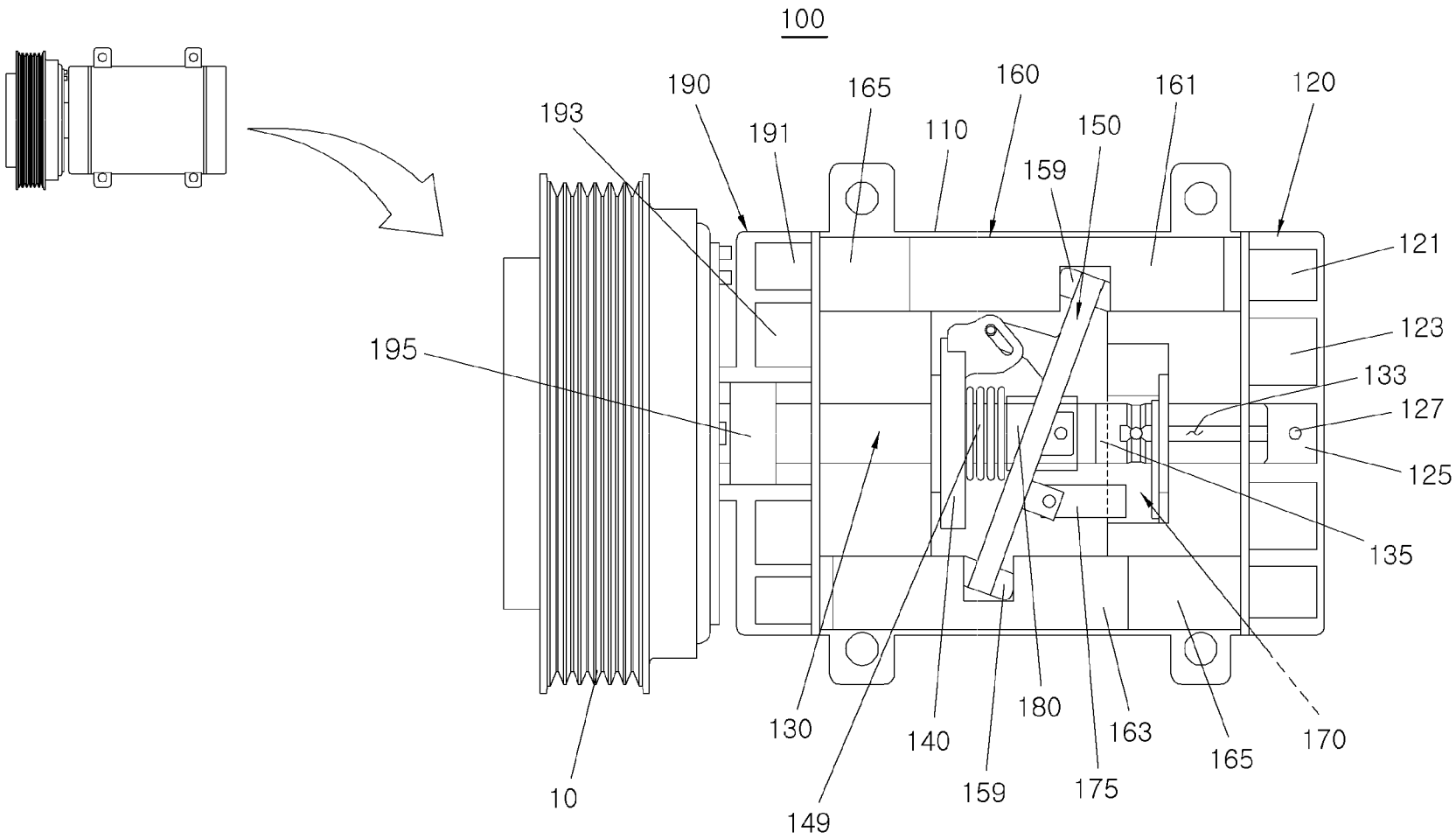
FIG. 2 is a cross-sectional view illustrating an example embodiment of a vehicle air-conditioner compressor in accordance with the present disclosure.
Figure 3A:
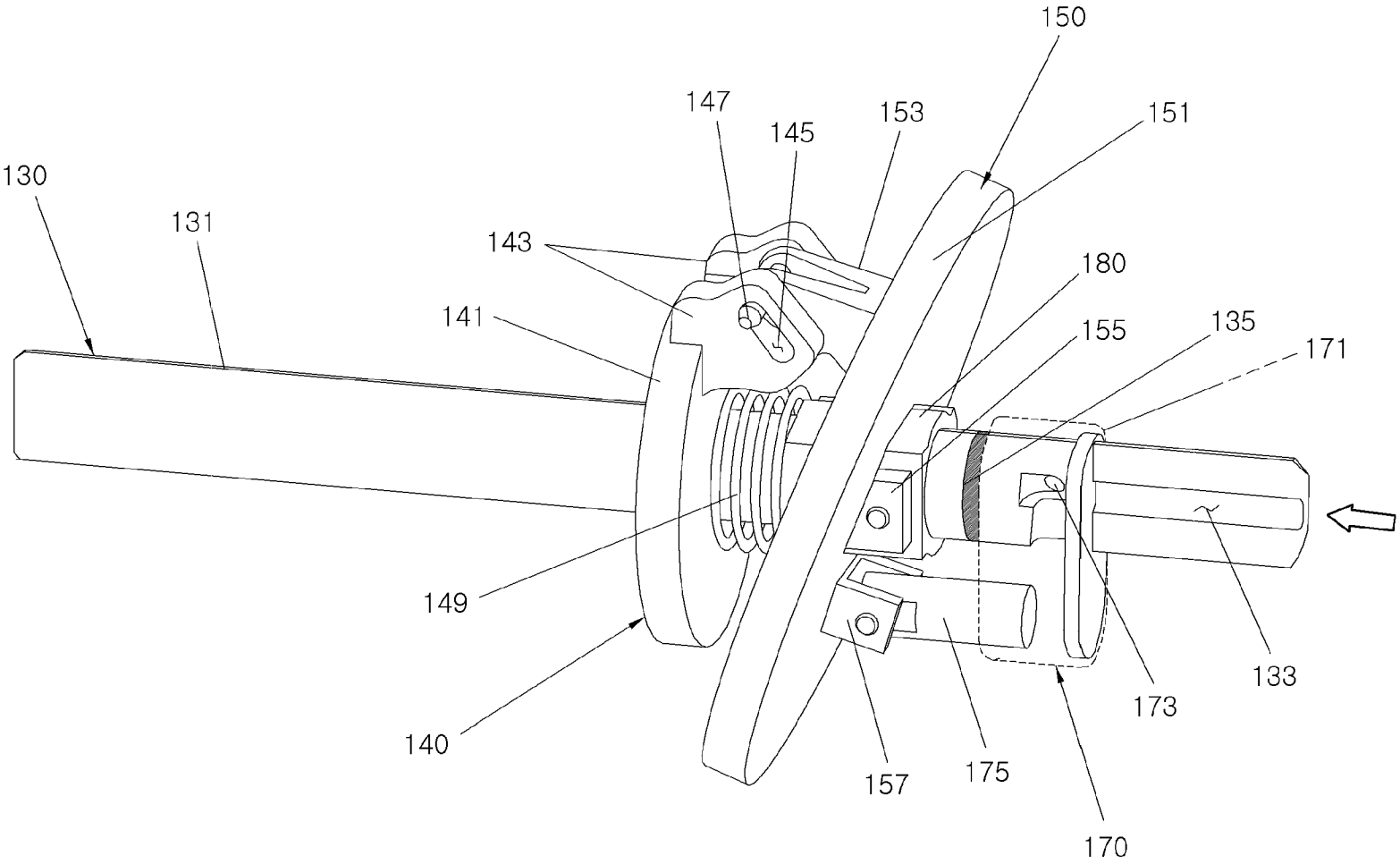
FIG. 3A is a perspective view illustrating a portion of an example embodiment of a vehicle air-conditioner compressor in accordance with the present disclosure.

FIG. 2 is a cross-sectional view illustrating an example embodiment of a vehicle air-conditioner compressor. FIG. 3A is a perspective view illustrating a portion part of an example embodiment of a vehicle air-conditioner compressor, and FIG. 3B is a diagram illustrating the internal operation of an example embodiment of a vehicle air-conditioner compressor.

Figure 3B:
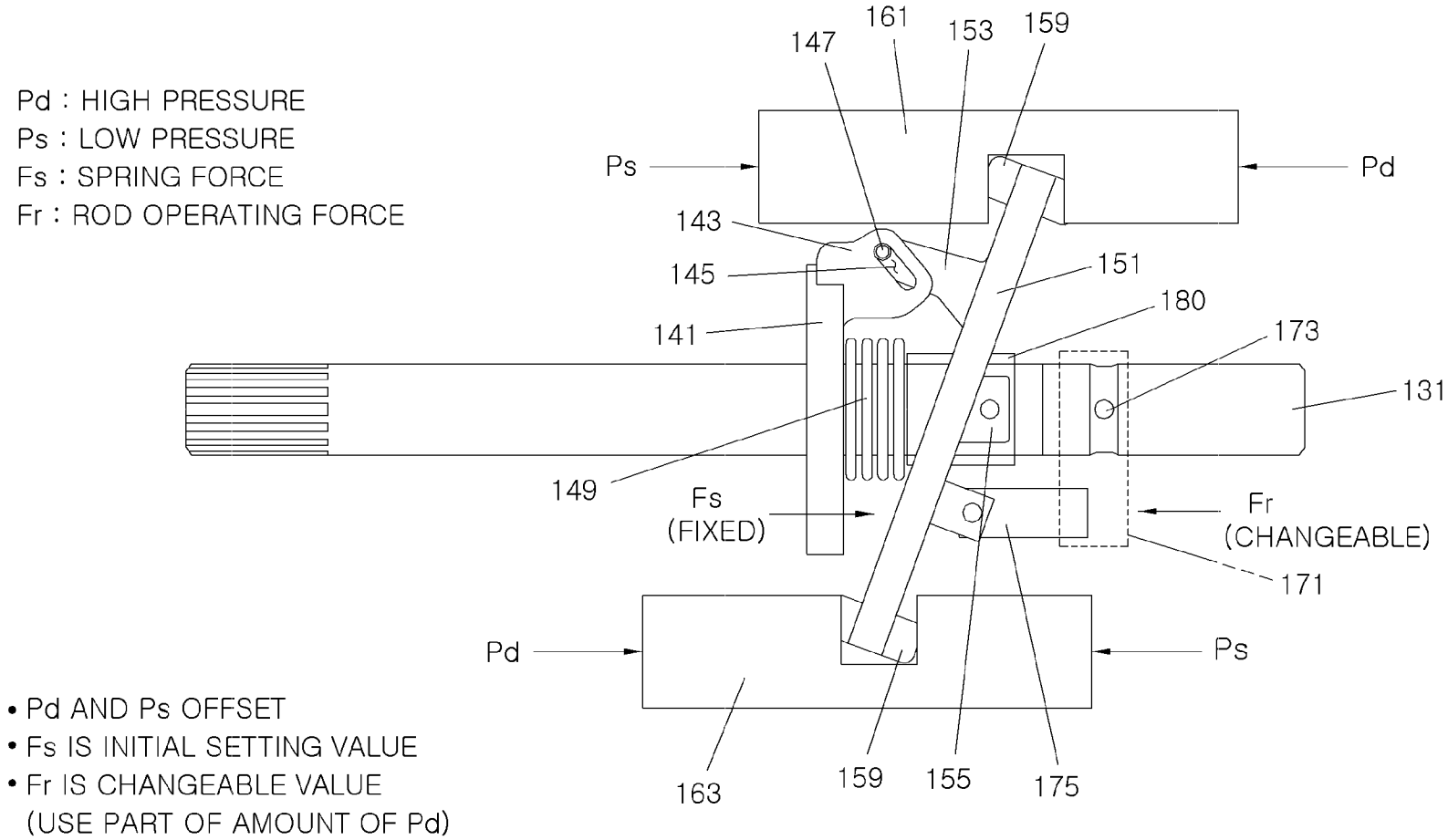
FIG. 3B is a diagram illustrating the internal operation of an example embodiment of a vehicle air-conditioner compressor.

Referring to FIGS. 2 to 3B, an example embodiment of a vehicle air-conditioner compressor 100 comprises: a housing 110, a rear housing 120, a shaft 130, a lug 140, a swash plate 150, pistons 161 and 163, a cylinder 165, a second pressure-sensing chamber 170, a bushing 180, and a front housing 190.

Vehicle air-conditioner compressor 100 also includes a pulley 10 disposed at an outer side of front housing 190 that receives rotational force from a rotational power source such as an engine or a motor.

Housing 110 accommodates shaft 130, lug 140, swash plate 150, pistons 161 and 163, cylinder 165, second pressure-sensing chamber 170, and bushing 180 therein. Front housing 190 is disposed at the pulley 10 side of housing 110, and rear housing 120 is disposed at an opposite side thereof.

Figure 4:
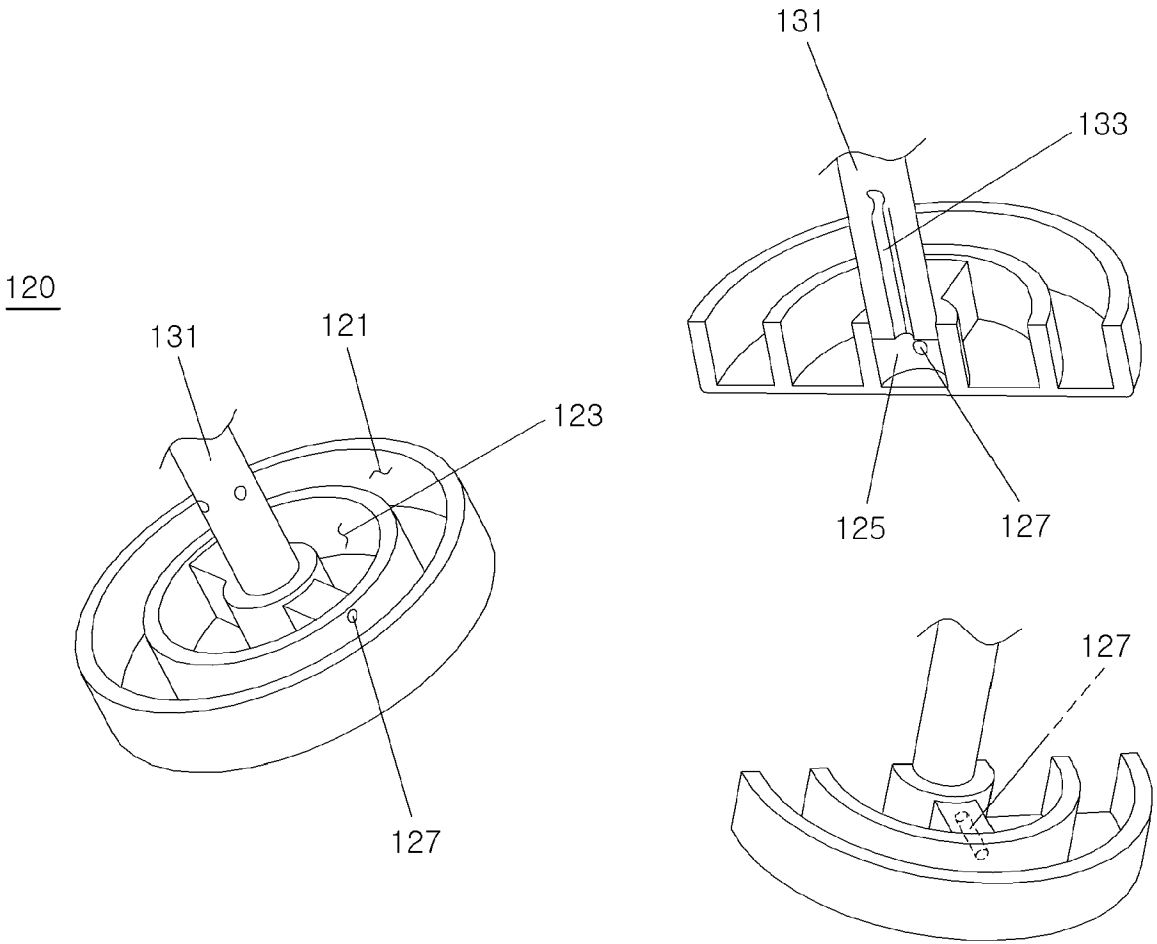
FIG. 4 is a perspective view illustrating a rear housing of an example embodiment of a vehicle air-conditioner compressor.
Figure 5A:
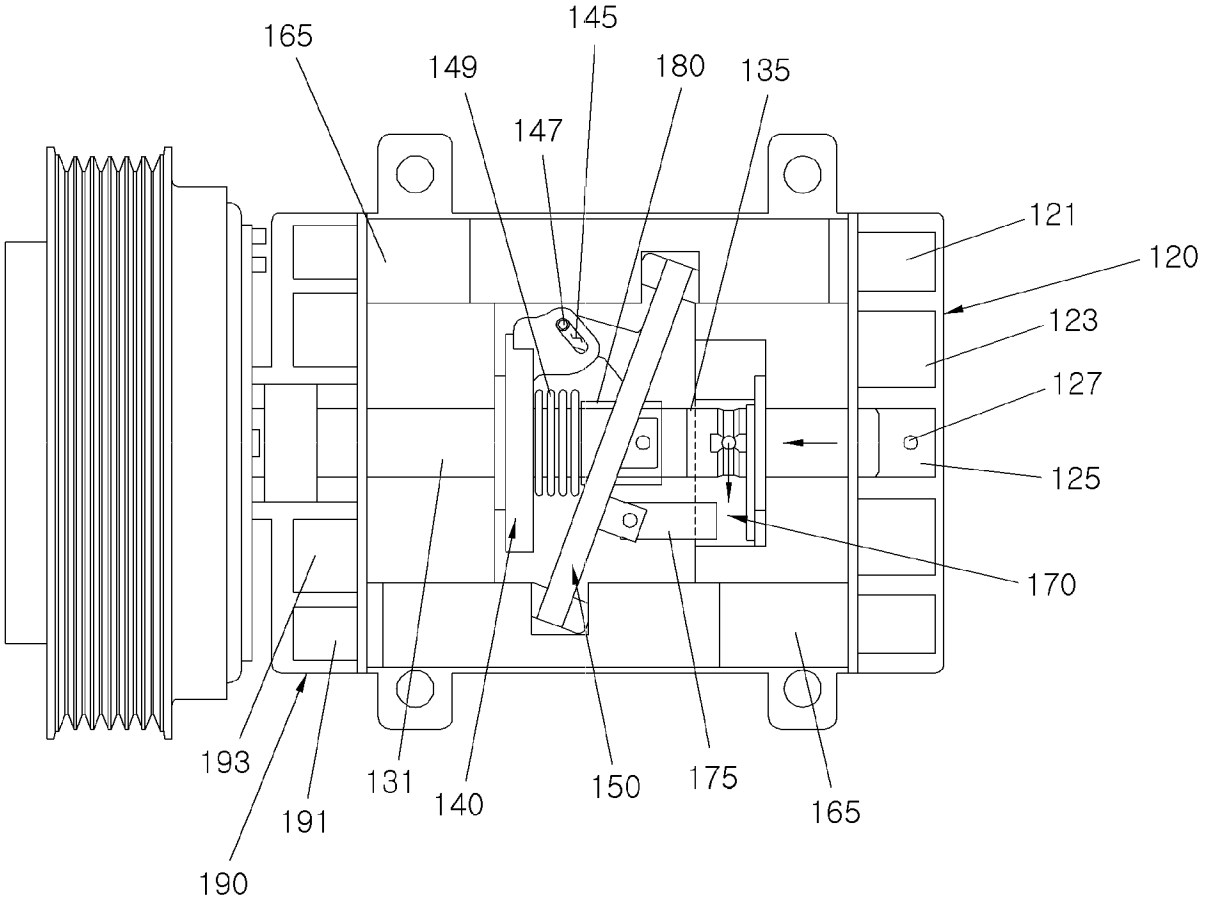
FIG. 5A is a cross-sectional view illustrating an example embodiment of a vehicle air-conditioner compressor at maximum inclination of a swash.
Figure 5B:
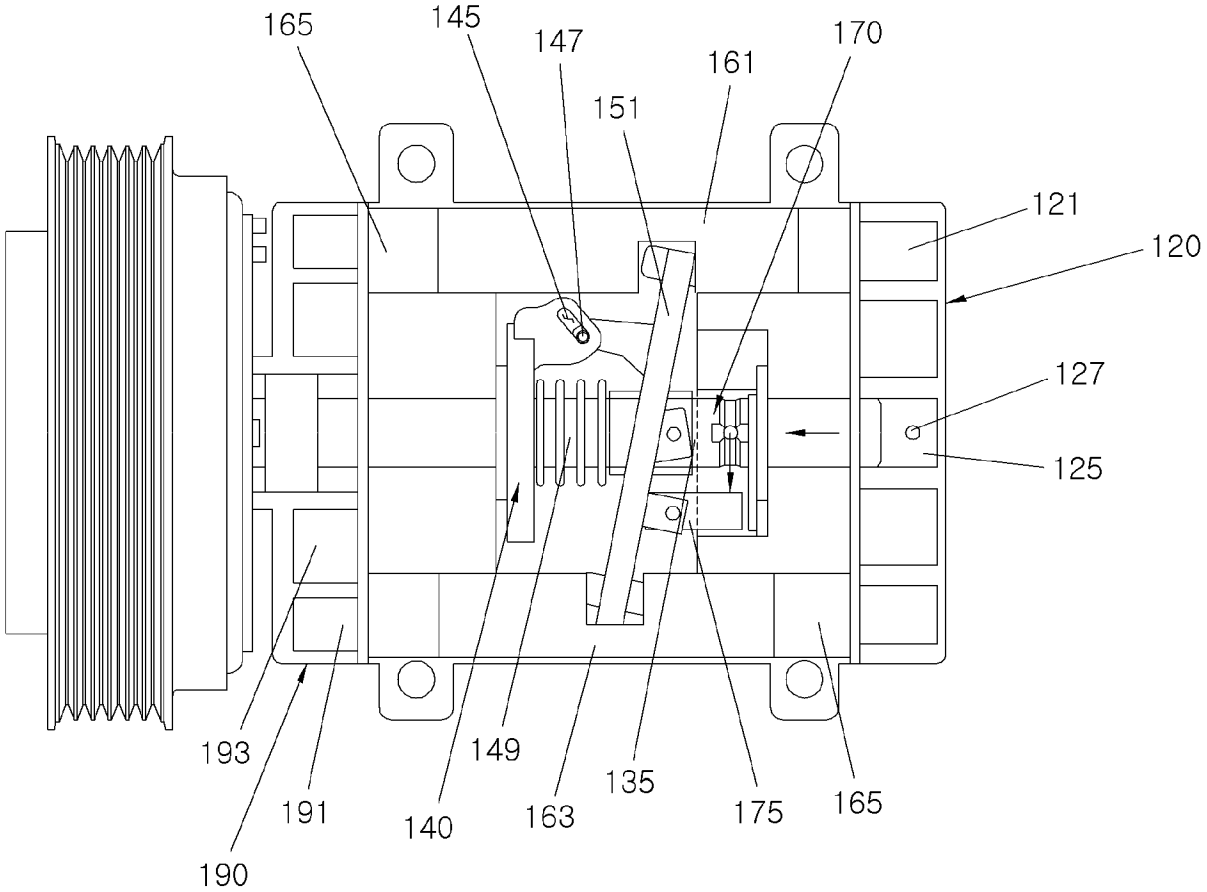
FIG. 5B is a cross-sectional view illustrating an example embodiment of a vehicle air-conditioner compressor at minimum inclination of a swash plate.

FIG. 4 is a perspective view illustrating a rear housing of an example embodiment of a vehicle air-conditioner compressor.

Referring to FIG. 4, rear housing 120 includes a first pressure-sensing chamber 125 into which shaft 130 is press-fitted, a low-pressure chamber 123 surrounding first pressure-sensing chamber 125 and communicating with housing 110 and cylinder 165, and a high-pressure chamber 121 surrounding low-pressure chamber 123.

A communicating channel 127 is formed between high-pressure chamber 121 and first pressure-sensing chamber 125, such that the high pressure of the high-pressure chamber 121 is transferred to the first pressure-sensing chamber 125. The pressure of the first pressure-sensing chamber 125 is transferred to the second pressure-sensing chamber 170 through a communicating hole 133 formed in the shaft 130. The communicating channel extends between the first high-pressure chamber and the first pressure-sensing chamber across internal space of the first low-pressure chamber.

Rear housing 120 may have a cylindrical shape, and the high-pressure chamber 121 does not directly communicate with the low-pressure chamber 123.

Rear housing 120 may have a cylindrical shape, and does not communicate with high-pressure chamber 121 or the low-pressure chamber 123.

Shaft 130 is rotatably installed at the center of the housing 110. A first end of shaft 130 protrudes to the outside of housing 110 and front housing 190, and pulley 10 is mounted thereon. The pulley transmits rotational force from a rotational power source to shaft 130. A second end of shaft 130 penetrates through housing 110 and is press-fitted into first pressure-sensing chamber 125 of rear housing 120 and coupled to the first pressure-sensing chamber 125.

Communicating channel 133 formed in shaft 130 transfers the high pressure of the first pressure-sensing chamber 125 to the second pressure-sensing chamber 170.

A stopper 135 is disposed on an outer circumferential surface of a shaft body 131 adjacent to second pressure-sensing chamber 170, and is used to set a minimum inclination of swash plate 150. The minimum inclination of swash plate 150 may be 1 degree or greater.

A rotation center of lug 140 is connected at a preset position of shaft 130 in housing 110, and the lug 140 rotates around a rotation center axis due to rotation of shaft 130.

Lug 140 includes a rotating plate 141, a hinge body 143 at one end of rotating plate 141, a slot hole 145 in the hinge body 143, and a hinge pin 147 that slides along the slot hole 145 and is coupled with one side of hinge body 143 and one side of swash plate 150.

A spring 149 having a preset spring constant is installed between rotating plate 141 of lug 140 and bushing 180 to elastically move swash plate 150 connected to bushing 180.

Rotating plate 141 may be coupled with swash plate 150 to rotate together with swash plate 150.

When the inclination of swash plate 150 is at a maximum value, hinge pin 147 is positioned at one end of slot hole 145, and when the inclination of swash plate 150 is at a minimum value, hinge pin 147 is positioned at the other end of slot hole 145.

Swash plate 150 may be coupled with lug 140 by a first hinge part 153 at one side thereof to rotate together with lug 140, and may also be coupled by a second hinge part 157 through a rod 175 of the second pressure-sensing chamber 170 at the other side thereof to change the inclination thereof. Further, swash plate 150 may be coupled with bushing 180 sliding along shaft 130 by a third hinge part 155. Swash plate 150 rotates while being connected to pistons 161 and 163 by a shoe 159 disposed on each side of swash plate 150.

First hinge part 153 may move while sliding along slot hole 145 through hinge pin 147. Second hinge part 157 is connected to rod 175 to transfer an operating force of rod 175 to swash plate 150. Third hinge part 155 allows swash plate 150 to have an inclination that may be changed with respect to bushing 180.

Pistons 161 and 163 are reciprocatingly moved by swash plate 150. As the inclination of swash plate 150 is changed, the discharge capacity is also changed.

Pistons 161 and 163 are provided to correspond to a cylinder 165 formed at an inner circumferential surface of housing 110 in a length direction, and are each connected to swash plate 150 through a shoe 159 at an outer edge of a swash plate body 151 of the swash plate 150.

When swash plate body 151 of swash plate 150 rotates, pistons 161 and 163 reciprocate in cylinder 165 to compress fluid, including coolant, in cylinder 165 and transfer the compressed fluid to high-pressure chambers 121 and 191.

In the example embodiment described above, a fluid including the coolant discharged from an evaporator is led into housing 110, and transferred to cylinder 165 through low-pressure chambers 123 and 193. The fluid in cylinder 165 is then compressed to a high-temperature, high-pressure gaseous state by action of pistons 161 and 163 and discharged to a condenser through high-pressure chambers 121 and 191.

At this point, some high pressure fluid in high-pressure chamber 121 flows to the second pressure-sensing chamber 170 through communicating hole 133. Second pressure-sensing chamber 170 is coupled with rod 175 at the other side of the swash plate 150, and operates the rod using the pressure provided from the high-pressure chamber 121 of the rear housing 120. Operation of rod 175 changes the inclination of swash plate 150 in a direction perpendicular to a length direction of shaft 130, thereby adjusting the discharge capacity.

Second pressure-sensing chamber 170 includes a pressure-sensing chamber body 171 coupled with shaft 130, and a pressure transfer part 173 transferring the pressure of the communicating hole 133 to rod 175. Rod 175 transfers a force to the swash plate to change the inclination of the swash plate 150 due to the pressure of high-pressure chamber 121.

When the operating force of rod 175 is higher than a spring force of spring 149, the inclination of swash plate 150 is increased, and when the operating force of rod 175 is lower than the spring force of spring 149, the inclination of the swash plate 150 is decreased.

Bushing 180 slides along shaft 130 and moves swash plate 150 in the length direction of shaft 130 or changes the inclination of swash plate 150.

Bushing 180 is disposed between lug 140 and stopper 135 and may move along shaft 130. The distance of travel of bushing 180 is determined by the spring force of spring 149. Bushing 180 may a distance commensurate with the maximum spring force of spring 149 unless stopped by stopper 135.

Front housing 190 includes a support 195 rotatably supporting the shaft, a low-pressure chamber 193 surrounding support part 195 and communicating with housing 110 and cylinder 165, and a high-pressure chamber 191 surrounding low-pressure chamber 193.

Referring to FIGS. 3A and 3B, an internal operation of the example embodiment of the vehicle air-conditioner compressor is described in greater detail.

As described above, a fluid such as an air conditioner coolant discharged from the evaporator is led into housing 110 and moved to cylinder 165 through low-pressure chambers 123 and 193 in the rear and front housings, respectively. The fluid in cylinder 165 is compressed to a high-temperature, high-pressure gaseous state by the action of pistons 161 and 163 and discharged to the condenser through high-pressure chambers 121 and 191.

As pistons 161 and 191 reciprocatingly move in cylinder 165, they create high pressure in the high-pressure chamber closest to the piston. For example, as shown in FIG. 2 Piston 161 is closest to and therefore creates high pressure in high-pressure chamber 121, whereas piston 163 is closest to and creates high pressure in high-pressure chamber 191. On the other sides of pistons 161 and 163, low pressure is formed. Pistons 161 and 163 are formed to be symmetrical with respect to swash plate 150 such that a force generated by the high pressure and a force generated by the low pressure offset each other.

As shown in FIG. 2, in cylinder 165, piston 161 discharges the high-temperature, high-pressure fluid to high-pressure chamber 121 of rear housing 120, and piston 163 discharges the high-temperature, high-pressure fluid to high-pressure chamber 191 of front housing 190.

The inclination of swash plate 150 is changed by the operating force Fr of rod 175 based on the spring force of spring 149 or the maximum spring force Fs, and the pressure of high-pressure chamber 121.

In this case, the spring force is changed depending on the spring constant k and a distance of travel of bushing 180. Maximum spring force Fs is the force at which the spring 149 is maximally compressed such that hinge pin 147 is positioned at one end of the slot hole 145.

When the operating force Fr of rod 175 is greater than the spring force of the spring 149, the inclination of swash plate 150 is increased, and when the operating force of rod 175 is less than the spring force of spring 149, the inclination of the swash plate 150 is decreased. When the operating force Fr of rod 175 is equal to or larger than the maximum spring force Fs, the inclination of the swash plate 150 reaches its maximum value.

In accordance with the embodiments of the present disclosure, it is possible to improve fuel efficiency, power performance, and interior comfort by changing the inclination of a swash plate using pressure from a high-pressure chamber in a stationary compressor, while also decreasing cost because no control valve the process of altering the inclination of the swash plate.

The previously described embodiments are only examples to allow a person having ordinary skill in the art to easily practice the present disclosure. The present disclosure is not limited to the specific example embodiments described herein and the accompanying drawings. Accordingly, it will be apparent to those skilled in the art that substitutions, modifications and variations can be made without departing from the spirit and scope of the invention as defined by the appended claims and can also belong to the scope of the present invention.

What is claimed is:

1. A vehicle air-conditioner compressor, comprising:

a housing having a front housing section and a rear housing section;

a first pressure chamber disposed in the rear housing section;

a shaft rotatably installed in the housing;

a lug fixed at a preset position on the shaft;

a swash plate coupled with the lug at one side thereof and rotating together with the lug;

a piston connected to the swash plate by a shoe and moved reciprocatingly by the swash plate;

a cylinder disposed in the housing that accommodates the piston therein;

a bushing coupled with the swash plate and sliding along the shaft;

a spring installed between the lug and the bushing to elastically move the swash plate connected to the bushing;

a second pressure-sensing chamber coupled with a rod at the side of the swash plate opposite the lug, wherein pressure provided from the first high-pressure chamber of the rear housing section causes the rod to move and thereby changes an inclination of the swash plate;

the rear housing section further comprises:

a first pressure-sensing chamber into which the shaft is press-fitted;

a first low-pressure chamber surrounding the first pressure-sensing chamber; and the first high-pressure chamber surrounding the first low-pressure chamber;

wherein a communicating channel is formed between the first high-pressure chamber and the first pressure-sensing chamber without a control valve therebetween, and the communicating channel extends between the first high-pressure chamber and the first pressure-sensing chamber across internal space of the first low-pressure chamber;

wherein the first low-pressure chamber is separated from the first pressure-sensing chamber in the rear housing such that the first low-pressure chamber does not communicate with the first pressure-sensing chamber in the rear housing, wherein a communicating hole is formed in the shaft to transfer a pressure from the first pressure-sensing chamber to the second pressure-sensing chamber through the communicating hole; and wherein the inclination of the swash plate is changed by a difference between an operating force of the rod and a spring force of the spring, and the operating force of the rod is caused by the pressure transferred from the first high-pressure chamber to the second pressure-sensing chamber through the communicating channel and the communicating hole.

2. The vehicle air-conditioner compressor of claim 1, wherein a stopper is disposed on the shaft at one side of the second pressure-sensing chamber in the direction of the bushing.

3. The vehicle air-conditioner compressor of claim 2, wherein a minimum inclination of the swash plate with respect to a direction perpendicular to a length direction of the shaft of 1 degree or greater is set by the stopper.

4. The vehicle air-conditioner compressor of claim 1, wherein the front housing comprises:

a support rotatably supporting the shaft;

a second low-pressure chamber surrounding the support and communicating with the housing and the cylinder; and a second high-pressure chamber surrounding the second low-pressure chamber.

5. The vehicle air-conditioner compressor of claim 1, wherein the lug comprises:

a rotating plate;

a hinge body formed at one end of the rotating plate;

a slot hole formed in the hinge body; and a hinge pin sliding along the slot hole and coupled with one side of the hinge body and one side of the swash plate.

6. The vehicle air-conditioner compressor of claim 5, wherein endpoints of a range of motion of the hinge pin within the slot hole correspond to the minimum and maximum inclinations of the swash plate.

7. The vehicle air-conditioner compressor of claim 1, wherein the piston comprises a plurality of pistons arranged in symmetrical pairs about a center point of the swash plate, and high pressure is generated on one side of the piston and low pressure is generated on the opposite side of the piston, and wherein the piston is symmetrical around the swash plate so that the forces generated by the high pressure and the low pressure offset.

* * * * *